United States Patent [19]

Pavis

[11] 4,124,214

[45] Nov. 7, 1978

[54] METHOD AND APPARATUS FOR INTERPRETIVE GAME

[76] Inventor: Jesse A. Pavis, 35 Clark St., Brooklyn, N.Y. 11201

[21] Appl. No.: 718,451

[22] Filed: Aug. 30, 1976

[51] Int. Cl.[2] ..... A63F 3/00

[52] U.S. Cl. ..... 273/249; 273/243; 35/22 R

[58] Field of Search ..... 35/22, 69, 22 R; 273/134, 134 AD, 134 C, 134 D, 134 E, 134 AT, 134 BD, 134 ER, 243, 248, 249

[56] References Cited

U.S. PATENT DOCUMENTS

| | | | |
|---|---|---|---|
| 1,635,734 | 7/1927 | Ziegler | 273/134 AT UX |
| 3,124,358 | 3/1964 | Weedman | 273/134 AT UX |
| 3,815,919 | 6/1974 | Cain et al. | 273/134 AD |
| 3,939,578 | 2/1976 | Coffey | 273/134 AD |
| 4,029,320 | 6/1977 | Hausman | 273/134 AD |

FOREIGN PATENT DOCUMENTS

| | | | |
|---|---|---|---|
| 867,150 | 5/1961 | United Kingdom | 273/134 AT |

*Primary Examiner*—Richard C. Pinkham
*Assistant Examiner*—Harry G. Strappello
*Attorney, Agent, or Firm*—Darby & Darby

[57] ABSTRACT

A method and apparatus for playing a game by posing a question to a player to elicit one of several possible responses, each of the possible responses having an answer value differing from answer values of other responses, the answer value of the selected answer determining the player's change of position in the game.

The questions presented may relate a dream and its context, and require the player to select one of several possible interpretations. His playing position is adjusted in proportion to the accuracy of the selected interpretation.

The questions presented may be broken into subsets, each subset comprising questions of comparable difficulty. The subset from which the question for that playing turn will be taken may be determined in such manner that the likelihood of selecting a subset with questions of higher difficulty is smaller than the likelihood of selecting a subset with questions of lower difficulty.

21 Claims, 10 Drawing Figures

METHOD AND APPARATUS FOR INTERPRETIVE GAME

BACKGROUND OF THE INVENTION

This invention relates generally to the field of games. Various types of games are known to the prior art and include games of pure chance, such as roulette, bartering types of games, such as "Monopoly", memory games, such as "Concentration", games where one team member elicits proper answers from teammates by giving various types of clues, such as "charades" or "password", and others. Each of these popular games is competitive, and scoring or movement of a player marker along a gameboard is determined by chance or by player response. In each of these games known to the prior art, however, the scoring or player movement is determined according to an "all-or-nothing" rule. That is to say, in games where player judgment or response is required, the answer has only one of two answer values — a correct response or an incorrect response.

In none of the games of the prior art is scoring or player movement determined by a player response to a question where the responses may each take a relative answer value, i.e., "most correct", "acceptable", "unacceptable", or "grossly unacceptable". The present invention provides for such scoring.

In the field of games heretofore known, no game deals specifically with the subject of dream interpretation. This area has been the subject of study by man for thousands of years. In many societies there have been selected members such as shamans, medicine men, and others, who the society believed to be gifted or skilled in dream interpretation. The meaning of an individual's dream was considered important, for instance as an augury or hidden truth concerning the dreamer or communication from the dead.

Current studies estimate that people spend about twenty percent of their sleeping time dreaming. They dream four or five times a night, and each dream lasts about twenty minutes. Consequently, everyone has a variety of dreams which may be subject to interpretation.

There is no certain way of interpreting dreams, and, in fact, any dream interpretation is hypothetical. A variety of distinct schools of thought have developed as followers of, for instance, Alfred Adler, Sigmund Freud, Carl Jung, and Frederick Perls. Consequently, therapists variously identify themselves with differing theories of dream interpretation and structure their analyses accordingly.

A wealth of literature is available on the subject of psychoanalysis, psychology, and dream interpretation presenting in academic fashion certain theories of analysis and their necessary framework for dream interpretation. While this material has been presented in literary form or through lectures, both in an academic context, it has not heretofore been the subject of a game.

SUMMARY OF THE INVENTION

Accordingly, it is an object of the present invention to provide a game using questions propounded to the various game players with player scoring or advancement determined by the answering response of the player, with each of several possible responses having varying answer values.

Another object is to provide a game to test the player's ability to interpret various information dealing with a variety of subject areas.

A further object is to provide a recreational game of skill and acumen.

Still a further object is to provide a recreational game which will educate its game players.

Another object is to provide a game where a variety of answers may be given by a game player to a question propounded, and the relative value of the particular answer given determines the scoring or player advancement in the game.

Another object is to provide a game where the questions which may be asked of a game player vary in degrees of difficulty, and where the benefit or detriment to be gained or lost by the responses varies in proportion with the difficulty of the question.

Still a further object of this invention is to provide a game where questions to be asked of a player have varying degrees of difficulty, and where the selection of the question to be propounded is determined by chance, where the probability of selecting a question of lower difficulty exceeds the probability of selecting a question of higher difficulty.

Another object of this invention is to provide a game where the game players are required to interpret the meaning of a dream.

A further object of this invention is to provide a game where a player's interpretation of a dream is measured against an interpretation of that same dream in the same context by a prevailing school of thought.

Briefly, these and other objects are achieved by providing a game for two or more players where each player in turn is asked a selected question in a given area of subject matter, the responses to which have relative values as determined by accepted theories of the prevailing schools of thought. Each possible player response is associated with a player scoring addition or loss, or position marker advancement or retreat, in accordance with the relative answer value associated with the player's response. The questions may be in predetermined order or may be selected at random or by choice of the player. The questions may be divided into subsets, with selected subsets havine more difficult questions than other subsets. Both the subset and the included question may be selected in predetermined order, or by selection by the player, or by a chance event. In one embodiment, the questions may relate a dream and its context or selected facts relating to the dreamer, and ask the game player to select one of a possible number of dream interpretations. Each interpretation may have a relative answer value in accordance with interpretation of that same dream and context by prevailing schools of thought in dream analysis.

BRIEF DESCRIPTION OF THE DRAWINGS

In describing the preferred embodiment of the present invention, reference will be made to the appended drawings in which.

DESCRIPTION OF A PREFERRED EMBODIMENT

Figure 1:
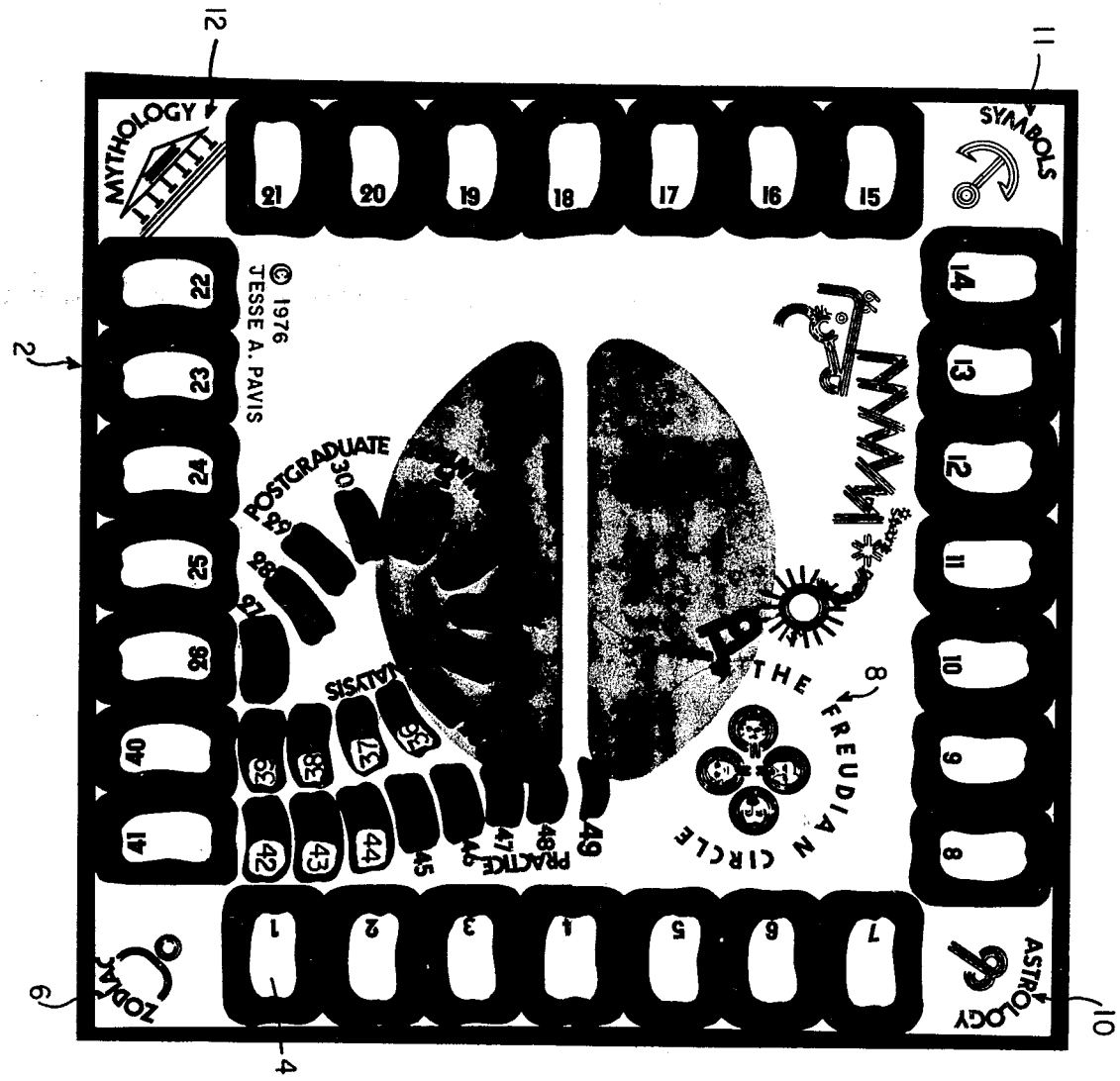
FIG. 1 is a plan view of a gameboard for playing one game of dream interpretation.

FIG. 1 shows a gameboard 2 particularly adapted to playing a game according to the present invention dealing with the subject matter of dream interpretation. Certain of a plurality of marker spaces 4 are disposed around the board periphery, and others extend into the central area of the square gameboard 2. The marker spaces 4 are preferably serially numbered for the orderly progression of player markers 14 around the board. The gameboard 2 includes a starting position 6 and a winner circle or position 8. The starting position 6, adjacent the marker space "1" is disposed at one corner of the gameboard 2 and is labeled "Zodiac". The remaining three corners 10, 11 and 12 of the gameboard 2 are respectively labeled "Astrology", "Symbols", and "Mythology". As will be seen, these corners may be designated as other categories of information.

After leaving the starting position 6, and proceeding around the perimeter of the gameboard 2, in accordance with the digits associated with each marker space 4, the course of the game may follow marker spaces disposed in any desired fashion in the center of the board, so long as the course leads to a winner's circle or position 8, here designated "Freudian Circle". It is not necessary that the game course proceed around the perimeter of the board, or even that the board be square. Any regular or irregular geometric shape may be used, such as a pentagon, hexagon, triangle, or such irregular shapes as a large questionmark or a plan or elevational view of a human cerebrum. In the form illustrated, the spaces numbered 1 to 26 extend around the periphery of the board 2, and are interspersed with the "Astrology", "Symbols" and "Mythology" corner positions. The sequence of numbered spaces continues as Nos. 27 through 32, designated "Postgraduate Training", to Nos. 33 through 39, designated "Analysis", to return to Nos. 40 and 41 on the perimeter. The sequence continues from Nos. 42 to 49, designated "Practice" to the goal marked "Freudian Circle". Thus the advancement along the numbered spaces represents progressively regular study, postgraduate training, psychoanalysis and professional practice until the goal of the Freudian Circle is attained. In essence, a player's position on the numbered spaces indicates his level of achievement and his progress through the spaces represents his advancement towards the ultimate level of achievement.

Figure 4A:
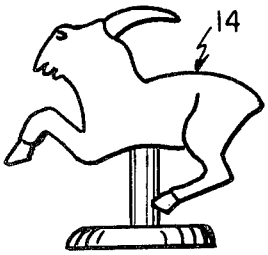
FIGS. 4*a*, 4*b* and 4*c* are diagrammatic illustrations of player markers which may be used in playing the game.
Figure 4B:
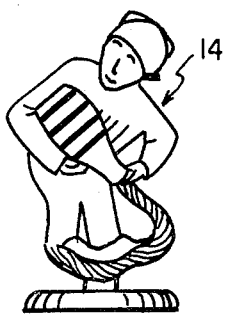
Figure 4C:
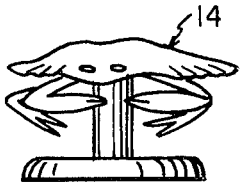
Figure 5A:
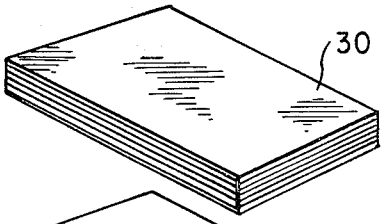
FIGS. 5*a*, 5*b* and 5*c* show three decks of corner cards used in playing the game.
Figure 5B:
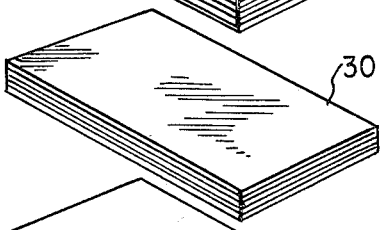
Figure 5C:
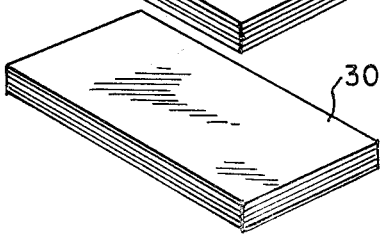
Figure 6:
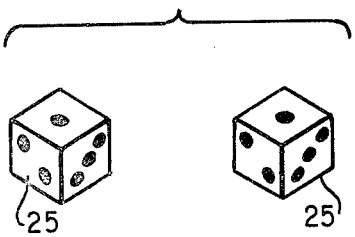
FIG. 6 illustrates a chance device for selecting a question by each player during his turn.

Three distinctive markers 14 are shown in FIGS. 4*a*, 4*b* and 4*c* for movement along the markers spaces 4. These markers 14 may assume any shape desired so long as they are distinguishable and each will fit on a marker space 4. In the present embodiment, Zodiacal figures are preferably employed, and FIGS. 4*a*, 4*b* and 4*c* show certain figures associated with the Zodiac signs of "Aries", "Aquarius", and "Cancer". These figurines, as members of the Zodiac signs, connote the imprecise science of dream interpretation, and are particularly well-suited to comport with the astrological, symbological, and mythological features of this game. Alternatively, markers having portraits or comprising figurines of prominent philosophers, psychiatrists, or psychologists are suggested. The number of markers should be sufficient to accommodate the desired number of game players, which must be at least two.

Figure 2:
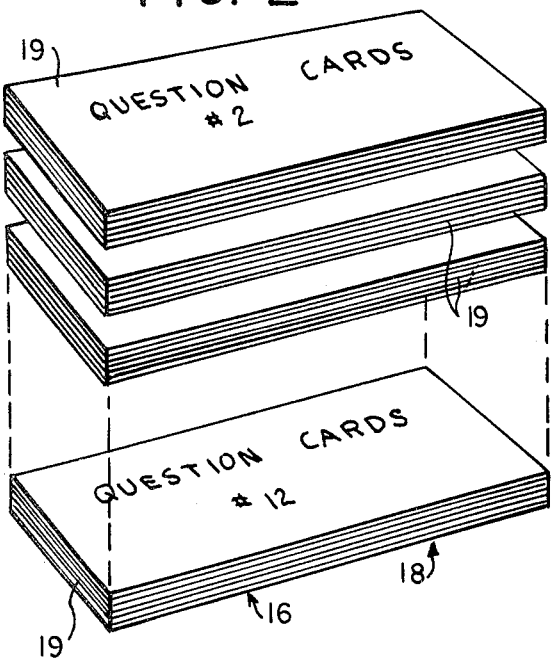
FIG. 2 is a diagrammatic illustration showing a set of question cards for the game divided into subsets.
Figure 3:
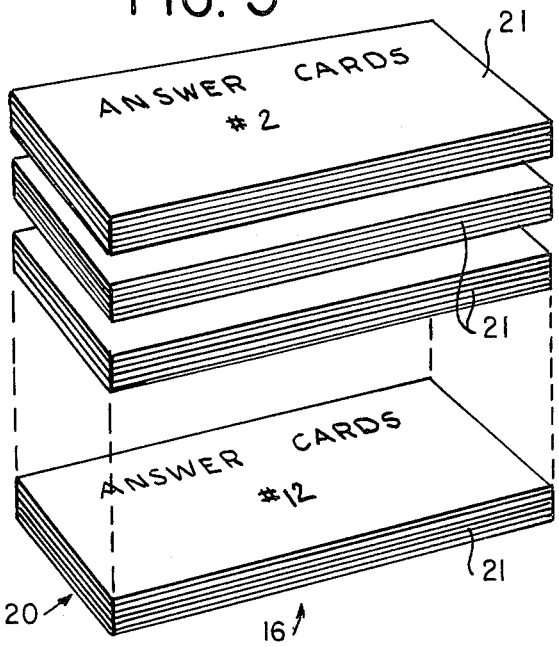
FIG. 3 is a diagrammatic illustration of a set of answer cards divided into subsets corresponding to the question card subsets.

The plurality of player-movement determining items 16 shown in FIGS. 2 and 3 comprise a set of question cards 18 and a set of answer cards 20. Each question card includes indicia indicating a question for which a player response is required. Illustratively these questions may comprise a short narrative dealing with the context or dream history of a dreamer, a brief description of a dream, and a question requiring the player to interpret the dream by selecting one of a plurality of predetermined answers. Each of the answer cards corresponds to a respective one of the question cards 18 and includes indicia to indicate a player score gain or loss or a magnitude of marker advancement or retreat along the gameboard marker spaces 4. In essence, the answer cards provide for an adjustment in a player's achievement level in accordance with his answer to the selected question. Wide latitude is embraced by this arrangement, the only essential feature being that the player responses to questions are associated with corresponding varying answer values. Thus, it is not necessary that the question be presented on a card separate from the answer card. The question may be read verbally by another player or by a non-player who reads from a single card, or from a booklet and may have immediate access to the answer values, as is a common arrangement for games played on broadcast television. Neither is it necessary that the questions deal with the interpretation of dreams. So long as the question is framed reasonably to elicit one of a number of responses, with each response having a corresponding individual answer value, then any subject area may be explored. For instance, the question may deal with the interpretation of art, theater, or music. The question may ask for an interpretation of historical fact or an economic situation or may require the player to answer a question dealing with science or sport. Thus, although the embodiment described relates to the interpretation of dreams, it will be understood that any subject area may be utilized so long as each question is associated with a number of responses having varying degrees of accuracy, probability or correctness, which thereby permits a corresponding variation in player advancement or detriment according to the elicited response.

Neither is it essential that the questions be presented in multiple choice form. Thus, the questions may be framed as "matching-type" questions, where the player is required to watch each of a plurality of questions with a corresponding one a plurality of answers. An answer card or other appropriate answering key may score the player advancement or detriment in accordance with the value of the associations made by the player. Alternatively, the questions may be framed as "fill-ins" which require the player to read a question in the form of an incomplete sentence, leaving the completion to the player. The answer card or other answering key could provide a predetermined advancement or detriment to the player for each of several likely responses, even though it would not be certain to cover all possible responses of a "fill-in" question.

The player-movement determining items 16 which present questions and weighted answers in the preferred form present interpretations drawn from a study of the work of many theorists and practitioners utilizing the most significant material developed by those working in the area of dream interpretation. The player should not therefore seek a single line of interpretation for the various dreams. Nor should he assume an arbitrary interpretation. Rather, the interpretation which is most closely related to the dreamer and situation should be selected. In general, dreams involve a variety of symbols, and a game player would have an advantage if he knows something about the use of such symbols. However, because the same feature in two dreams may symbolize two different antecedents, the game player should not rigidly apply a predetermined meaning to any one symbol.

The selected question card 18 may contain an indication that the dream is "recurrent". This means that the dreamer has had the same dream over a period of days or years, and this factor must be considered by the player in formulating his response. The recurrent dream usually points to a continuing problem faced by the dreamer which is reflected in the response choices for such questions. In the preferred embodiment other cards have also been marked with the indication that the player is "taking the position of" or "taking the role of . . . ". This is utilized where the dreamer supposes or imagines himself to be some other person, being or object in the dream. The question card indicates that the dream may be interpreted by taking the role of one of other persons, beings or objects.

A third variation on the dream question cards 18 is the inclusion of a statement from the dreamer that is called "association". This association means the first or key statement that a dreamer makes about his dream. Some schools of thought, particularly the Freudian, emphasize the necessity of obtaining continuous associations in dream interpretation. Other schools have pointed out that these associations can be unknowingly guided and that they may include a potpourri of antecedent thoughts, feelings, or happenings that have no relationship to the dream and should not be relied upon. The player is called upon to carefully analyze the dream in this context and judge how heavily he should rely on the associative material given.

In a fourth variation, certain question cards 18 may contain a number of dreams which have transpired during a single night. Many people working in dream interpretation believe that knowledge of other dreams that occur during the same night as the dream being interpreted assists the interpretation. Thus, the question cards 18 may include other dreams.

These four variations or special conditions described on the question cards raise particular problems of interpretation. These or other types of special conditions indicated on the question cards 18 may be grouped according to degrees of question difficulty into subsets 19. Thus, each question on a question card in any one of the selection card subsets 19 will have approximately the same difficulty. The answer pieces 20 will similarly be divided into subsets 21, and each of the question cards 18 will correspond to one answer card of the set 20 of the answer pieces. When a special condition is encountered, the opportunity for player advancement or detriment will be enhanced in the preferred embodiment, although this is not necessary. It will be appreciated that, in the preferred embodiment, the difficulty of the question is related to its potential achievement level-advancement value and that this value is the same for all questions in a subset.

The questions may be presented to a player in preselected order, or may be determined by chance, or a combination of order and chance. Thus, questions may be asked in turn of players in a predetermined order, thereby precluding player control or opportunity for variance of the question difficulty. For example, the question cards may be shuffled so that there is no order among the cards, while requiring that the players in rotation select cards from the top of the deck 18. Each of the question cards 18 would be identified with an answer key which may take the form of an answer card 20. Alternatively, the subset from which the question card 18 is selected may be determined randomly, as by the throw of dice, the spin of a roulette or similar wheel, the electronic random selection of a card number, or the blind selection by the player of one of the remaining cards.

In the preferred embodiment, a further embellishment is used. Each player selects a question card 18 by the roll of dice 25. Each of the numbers which may be thrown by the dice is associated with one of eleven subsets 19 of question cards. The questions indicated on the cards of the subset 19 associated with the dice throw totaling 7, the most probable number, are the least difficult questions. The most difficult questions are included in the subset 19 of question pieces 18 which correspond to the dice throw totaling either 2 or 12, the least probable throws. The question difficulty in the remaining subsets also varies inversely with the relative probability of throwing a selected number with the dice. The player marker movements associated with the most difficult question may have a wider range (i.e., greater advancement for the better answers and greater retrogression for the poorer answers) than the questions of lesser difficulty. This feature allows the opportunity for amplified player movement with the amplification factor varying inversely with the probability of a random event.

The square shape of the gameboard 2 provides a convenient corner starting position 6 and three other corners 10, 11, and 12 upon which to place corner cards 30. These cards may enhance the game by providing a second opportunity for a player to advance or retreat his marker 14. The corner cards 30 each include indicia indicating a question which requires a player response. The subject matter of the questions may vary if desired, or may be segregated into a respective particular type of subject matter for each of the three corners 10, 11, and 12. In the embodiment described, these corners illustratively have been labeled respectively for questions dealing with astrology, symbolism, and mythology. Each of the decks 30 includes a number of corner cards, each of which poses a question. The respective answers appear on the backs of the cards. Various rules may be devised to allow a player to select a corner card and may include, for instance, a second or third roll of doubles on the dice 25, a chance selection of a predetermined number or symbol, or advancement of the marker 14 along the marker spaces 4 to a position terminating on a corner space 10, 11 or 12. The questions may be objective rather than the subject of interpretation, and thereby elicit an answer which is either correct or incorrect, rather than a response having various relative answer values. Accordingly, a correct answer elicited from a player may allow that player's marker 14 to advance a bonus number of marker spaces 4 along the gameboard 2. If incorrect, the player may be forced to retreat a predetermined number of marker spaces 4. These corner cards have been selected from subject areas related to dream interpretation, and if this game is played in other subject areas, such as art, music, literature, science, economics or history interpretation, appropriate questions may be selected from corresponding related fields.

Set of Preferred Rules

A preferred method of play is as follows:

Each of the players selects a player marker 14 and the players throw one die or the dice to determine by the highest throw the player upon whom the privilege of the first move is conferred. Thereafter, playing will continue in clockwise rotation. The players arrange their markers 14 at the starting position 6 which is labeled with the indication "Zodiac". The first player throws the dice 25 to yield a certain number between 2 and 12. He then selects a question card 18. These question cards 18 are divided into eleven subsets 19. The cards of each subset are labeled with a digit and a letter, the digits ranging from 2 to 12 and the letters proceeding from A to H. If a player has rolled a 4, he selects the 4A card from the appropriate question subset deck 19. (The player who next rolls a 4 selects the "4B" question card 18 from the same No. 4 subset 19.). One of the other players reads the question to the player whose turn it is. The question comprises a short narrative dealing with a dream. At the end of the narrative are four interpretive statements, each of which is labeled "A", "B", "C", or "D". The player selects whichever interpretation he considers most accurate. After locating the answer card 21 which is labeled "4A" from the appropriate answer subset 21, either the player-in-turn or another player compares the answer selection with the legend on the answer card 20. For each of the interpretations A, B, C or D, an instruction will be given on the answer card 20 to advance or retract the player's marker a given number of spaces. If the most correct answer was the selection of the interpretation marked "C", the player will advance a greater number of marker spaces 4 than if he had selected a less correct answer. An incorrect answer would have a corresponding instruction on the answer piece 20 to retreat a certain number of marker spaces 4.

As an example, a question card selected by rolling a 12 with the dice may say:

"Situation: A young woman of thirty-four who is unhappy in her marriage and is thinking of having an affair with a friend."

"Dream: I meet a friend who has a white cat in a small cage. It is wild and mean and is perhaps an ocelot. The cage has two levels. The cat squeezes from the top to the bottom level. I open the cage just a tiny bit to let the cat get down to the bottom level. I was afraid that he was going to get out and I was sorry I had unlatched the cage. The cat was ferociously pushing against the door and bit and clawed my hand."

"Association: I am not sure who the friend was, but I think he's the man I am most interested in at the present time."

"Interpretation:

a. The woman is afraid that her friend who appears so quiet and nice is really a violent person.

b. The woman is afraid of having an affair because she believes it will only cause her suffering and pain.

c. The woman is full of deep feelings that she is too frightened to understand or express.

d. The woman unconsciously wants to be hurt."

After selection of one of the interpretations a, b, c or d, the answer card is consulted, which may read:

"a. Take six steps back.

b. Take two steps forward.

c. Take six steps forward.

d. Take two steps back."

Other questions, of varying degrees of sophistication and complexity, will appear on other question cards, graded in accordance with probability of selecting the card, and correspondingly graded answers will appear on the counterpart answer card.

The play proceeds in this manner with the markers 14 moving sequentially along the marker spaces 4 until one player wins the game by reaching the last marker space, "the Freudian circle", after passing the regions marked "Postgraduate Training", "Analysis", and "Practice", showing progress toward the goal.

Experienced players may adopt a variation whereby selection of incorrect answers by players in advanced positions along the gameboard 2 require a greater penalty. Thus, a player "in practice", (i.e., one whose marker 14 is on any marker space from number 45 to number 49), who selects an incorrect answer must retreat his marker 14 to the beginning of "analysis", marker space number 36. Similarly a player "in analysis" who selects an incorrect interpretation must retreat to the beginning of "postgraduate training", marker number 27. Finally, players in "postgraduate training" selecting wrong interpretations must retreat to the "Mythology" corner.

In moving along the marker spaces 4, any player who lands his marker 14 on one of the corners 10, 11, or 12, (or, alternatively, who passes one of the corners) must select a corner card 30 of the appropriate corresponding category. The corner card 30 for the corner 10 bear the legend "astrology". Selecting the top card from the "astrology" deck, the player-in-turn reads the question and formulates and pronounces his answer. Then each player in turn clockwise must answer the same question. After all players have formulated their answers and disclosed them, the selected corner card 30 is turned over to reveal the desired answer. Any correct answer merits an advance of the markers 14 a number of marker spaces 4, such as six. An incorrect answer by the player-in-turn may require a retreat of three marker spaces 4, while an incorrect answer by a player not in turn, may require a marker retreat of only two spaces. Alternatively, after each player determines his answer, without revealing it to the others, the answer card is consulted. If the player-in-turn is correct, he advances his marker the preset number of spaces. If not, he must retrogress a set number of spaces, and the next player (e.g., clockwise) is given a chance to advance or be put back, depending upon the correctness of his answer. This continues only until a correct answer is attained.

The corner cards 30 are utilized also by any player who rolls doubles on the dice 25. This procedure is the same as that described where a player landed his marker 14 at one of the corners.

In sum, the game described herein includes several novel features. The use of questions posed to the game players in turn, to elicit one of several possible responses, each response being associated with an answer value differing from answer values of other responses, is but one inventive aspect of the game. The use of the accuracy or degree of validity of an interpretation of a dream to determine player gain or loss is one of the other inventive features of the game.

Although the game is described herein as a board game, it need not be so limited. The players may play without a gameboard, which is one type of scoring device, and use others. For instance, the game may be scored by assigning point values to each possible response to a question of interpretation, and continuing the game until a certain score is accumulated. The scores could be recorded on paper or by an electronic display scoreboard, which is particularly well adapted for use with games played for television broadcast. Other arrangements for denoting player position may be used as desired.

The questions posed to the game players in the game described above are questions calling for an interpretation. Each of various interpretations of an event may have a certain merit, and call for a corresponding change in player position. It will be understood, however, that a game of interpretation may be played wherein only one of several possible responses is considered to be the correct response, and player position may be improved only by selecting that response. While such a scoring method follows an "all-or-nothing" rule, it does require an interpretation of an event, a novel feature of the present invention.

From the above description it will be apparent that the subject matter of this invention is capable of taking various useful forms, and it is preferred, therefore, that this disclosure be taken in an exemplary sense and the scope of protection afforded be determined by the appended claims.

What is claimed as the invention is:

1. A method of playing a game for a plurality of players comprising the steps of:

selecting by chance one of a plurality of player-movement-determining items, each of said items indicating a question of one of a plurality of different levels of difficulty and having at least two possible responses of varying validity, each of said possible responses having a respective relative answer value corresponding to the validity of the response and the level of difficulty of the corresponding question;

selecting one of said possible responses; and adjusting a scoring device in accordance with the relative answer value of the selected response.

2. The game method according to claim 1 wherein said adjusting a scoring device comprises moving a marker along a continuous main course on a gameboard, said main course including a series of marker spaces extending about said gameboard.

3. The game method according to claim 1 wherein said chance selection of a player-movement-determining item is characterized by selection of certain ones of said items having a probability of selection differing from probability of selection of others of said items, and each of said player-movement-determining items indicates a question having difficulty varying from other items, said difficulty correlating inversely to the probability of selection of said item.

4. The game method according to claim 1 wherein the magnitude of scoring adjustment corresponds to the difficulty of the question indicated on the selected player-movement-determining item.

5. A method for playing a game concerning the interpretation of dreams and played by a plurality of players, said game including a plurality of question cards forming question subsets each corresponding to the probability of a chance determination, comprising the steps of:

initiating a chance event by each of said players in order;

after each such initiation, selecting one of said subsets in accordance with the outcome of said chance determination;

selecting one of a plurality of question cards from said selected question subset, each of said question cards presenting a question dealing with the interpretation of a dream and requiring one of a selected number of player responses, each of said responses having a relative answer value differing from the relative answer value of at least one other response to said question;

selecting one of said responses; and varying said player's position of play in accordance with the relative answer value of the response to said question selected by said player.

6. The method according to claim 5 wherein each of said question subsets presents questions of a degree of difficulty differing from the degree of difficulty of questions of other question subsets, and the probability of selecting a question subset having questions of higher difficulty varies inversely with the degree of relative difficulty of said questions.

7. The method according to claim 6 wherein the selection of a response to a question of a question subset of higher degree of difficulty determines a greater change in player position than selection of a response to a question of a question subset of a lower degree of difficulty.

8. A board game apparatus for a plurality of players comprising:

a gameboard having a continuous main course, said main course including a series of spaces extending about said board;

a plurality of distinctive markers, each of said markers being moved along said spaces by a different one of said players in playing said game;

a set of player-movement-determining items including a set of questions of varying degrees of difficulty and a set of answers corresponding to each question, each answer having a movement value indicating the number of spaces a marker is to be moved along said main course by a player providing the answer in response to the question set forth on a selected movement-determining item, the movement value for each answer being related to the degree of difficulty of the corresponding question.

9. A board game apparatus for a plurality of players comprising:

a gameboard having a continuous main course, said main course including a series of spaces extending about said board;

a plurality of distinctive markers, one of said markers being utilized by each of said players in playing said game;

a set of question-posing items, each indicating a question of respective predetermined difficulty for which a player response is required, said question-posing set including a plurality of subsets of said question-posing items, all of the questions of the question-posing items in a particular subset being substantially of the same degree of difficulty, which differs from the degree of difficulty of the questions of the question-posing items in other subsets;

chance means for selecting a particular question-posing item subset from which a question-posing item is then selected, said chance means being constructed and arranged so that the probability of selecting a subset having questions having a higher degree of difficulty is less than the probability of selecting a subset including questions having a lower degree of difficulty; and a set of answer-indicating items, each corresponding to a respective one of said question-posing items and indicating the number of spaces a marker is to be moved along said main course as determined by the relative validity of the player's response to the question set forth on said corresponding question-posing items.

10. A game designed to test player's abilities in a field of knowledge and to assign each player to one of a predefined set of progressive achievement levels, comprising:

a scoring device for displaying each player's achievement level, said scoring device initially showing the lowest level for each player;

question posing means including a plurality of subsets of questions in said field of knowledge to be answered by the players, each subset having questions of a fixed level-advancement value different from other subsets;

a selector operated by each player for randomly indicating a subset from which a question is to be answered, said selector being adapted to indicate each question subset with a probability related to the level-advancement value thereof; and means for providing a level-adjustment value for each player in accordance with the answer he provides for a selected question and the level-advancement value of the question, said level-adjustment value being combinable with the achievement level indicated for that player by said scoring device to produce an updated achievement level.

11. A board game apparatus for a plurality of players comprising:

a gameboard having a continuous main course, said main course including series of spaces extending about said board;

a plurality of distinctive markers, one of said markers being utilized by each of said players in playing said game;

a set of player-movement-determining items including indicia for a set of questions of varying degrees of difficulty and a set of relative answer values corresponding to each question, each of said answer values indicating the number of spaces a marker is to be moved along said main course by a player as determined by the answer value of said player's response to the question set forth on a selected movement-determining item, the answer values of each question corresponding to the degree of difficulty of said question;

said player-movement-determining item set including a plurality of subsets of question-posing items, all of the questions of a particular subset being substantially of the same degree of difficulty, which differs from the degree of difficulty of the questions of other subsets;

said board game apparatus further comprising means for selecting a particular question-posing item subset from which a question is to be selected, said subset selecting means being constructed and arranged so that the probability of selecting a subset including questions having a higher degree of difficulty is less than the probability of selecting a subset including questions having a lower degree of difficulty.

12. A board game apparatus for a plurality of players and involving dream interpretation comprising:

a gameboard having a continuous main course including a series of marked spaces extending about said board;

a plurality of distinctive markers, each of said markers being moved along said marked spaces by a different one of said players in playing said game;

a set of dream cards describing dreams of different degrees of difficulty of interpretation, each dream card bearing a statement of a dream fact pattern and a plurality of possible interpretations of the dream, each of said possible interpretations having a relative validity differing from the others of said interpretations for the same dream fact pattern;

means for determining a dream card; and a set of answer cards, each corresponding to a respective one of said dream cards and indicating the number of spaces and direction a marker is to be moved on said main course for each one of the possible interpretations of the dream fact pattern represented on its corresponding dream card, the indicated movement behind related to the relative validity of the corresponding interpretation and the degree of difficulty of interpretation of the dream fact pattern.

13. The game apparatus according to claim 12 wherein said dream card set includes a plurality of subsets of dream cards, all of the dream fact patterns represented on the dream cards in a particular subset being substantially of the same degree of difficulty of interpretation, which differs from the degree of difficulty of interpretation of the dream fact patterns represented on the dream cards in other subsets; and said answer cards indicate greater marker movement corresponding to questions of higher difficulty than answer cards corresponding to questions of lower difficulty.

14. The game apparatus according to claim 13 wherein the determining means is constructed and arranged so that the probability of selecting a dream card on which are represented dream fact patterns having a higher degree of difficulty is less than the probability of selecting a dream card on which are represented dream fact patterns having a lower degree of difficulty.

15. The game apparatus according to claim 12 wherein certain of said dream cards indicate that said dream patterns are recurrent to the dreamer.

16. The game apparatus according to claim 12 wherein certain of said dream cards indicate that the dreamer of said dream fact patterns imagines himself to be taking the role of an object of said dream patterns.

17. The game apparatus according to claim 12 wherein certain of said dream cards indicate first statements of said dreamer about said dream patterns.

18. The game apparatus according to claim 12 wherein certain of said dream cards indicate that a plurality of dreams transpired during a single night by the dreamer.

19. A game designed to test players' abilities in a field of knowledge and to assign each player to one of a predefined set of progressive achievement levels, comprising:

a scoring device for displaying each player's achievement level, said scoring device initially showing the lowest level for each player;

question posing means including a plurality of questions in said field of knowledge to be answered by the players, each question being of a fixed level-advancement value selected from a plurality of different level-advancement values, each question having at least two possible answers of different validity;

a selector operated by each player for randomly indicating which question is to be answered; said selector being adapted to indicate each question subset with a probability related to the level-advancement value thereof; and means for providing a level-adjustment value for each player in accordance with the answer he provides for a selected question and the level-advancement value of the question, said level-adjustment value being combinable with the achievement level indicated for that player by said scoring device to produce an updated achievement level.

20. A game designed to test players' abilities in a field of knowledge and to assign each player to one of a predefined set of progressive achievement levels, comprising:

a scoring device for displaying each player's achievement level, said scoring device initially showing the lowest level for each player;

question posing means including a plurality of questions in said field of knowledge to be answered by the players, each question being of a fixed level-advancement value selected from a plurality of different level-advancement values indicative of the difficulty of the question, each question having at least two possible answers of different validity;

a selector operated by each player for randomly indicating which question is to be answered; and means for providing a level-adjustment value for each player in accordance with the answer he provides for a selected question and the level-advancement value of the question, said level-adjustment value being combinable with the achievement level indicated for that player by said scoring device to produce an updated achievement level.

21. A game in accordance with claim 20 wherein said selector is indexed with respect to the question posing means so as to indicate each question with a probability related to its level-advancement value.

* * * * *